US010258538B2

(12) United States Patent
Barta et al.

(10) Patent No.: US 10,258,538 B2
(45) Date of Patent: Apr. 16, 2019

(54) APPARATUS AND METHOD FOR PROVIDING EMERGENCY CPR FUNCTIONALITY ON A PATIENT SUPPORT SURFACE

(71) Applicant: Arjo IP Holding AB, Malmö (SE)

(72) Inventors: Eric Barta, San Antonio, TX (US); Steven Torno, San Antonio, TX (US); Lisa M. Paige, San Antonio, TX (US); Michael Oliva, San Antonio, TX (US); Rico Jaeger, San Antonio, TX (US); Randall P. Kelch, San Antonio, TX (US)

(73) Assignee: Huntleigh Technology Limited (GB)

( * ) Notice: Subject to any disclaimer, the term of this patent is extended or adjusted under 35 U.S.C. 154(b) by 0 days.

(21) Appl. No.: 16/014,750

(22) Filed: Jun. 21, 2018

(65) Prior Publication Data

US 2018/0296434 A1 Oct. 18, 2018

Related U.S. Application Data

(63) Continuation of application No. 14/698,143, filed on Apr. 28, 2015, now abandoned, which is a (Continued)

(51) Int. Cl.
*A61G 7/018* (2006.01)
*A61G 7/015* (2006.01)
(Continued)

(52) U.S. Cl.
CPC ..... *A61H 31/006* (2013.01); *A61G 7/015* (2013.01); *A61G 7/018* (2013.01); *A61G 7/0509* (2016.11);
(Continued)

(58) Field of Classification Search
CPC ..... A61G 7/002; A61G 7/005; A61G 7/012; A61G 7/015; A61G 7/018; A61G 13/02; A61G 13/04; A61G 13/06; A61G 13/08
(Continued)

(56) References Cited

U.S. PATENT DOCUMENTS 4,435,862 A 3/1984 King et al.
4,751,754 A 6/1988 Bailey et al.
(Continued)

FOREIGN PATENT DOCUMENTS

CN 2055380 U 4/1990
CN 1420753 A 5/2003
(Continued)

OTHER PUBLICATIONS

International Search Report issued for corresponding International Patent Application No. PCT/US2013/067295, dated Apr. 29, 2014, 3 pages.

*Primary Examiner* — Robert G Santos
(74) *Attorney, Agent, or Firm* — The Webb Law Firm

(57) ABSTRACT

Emergency CPR systems for patient support systems utilizing backup battery power. For example, an emergency CPR switch attached to a hospital bed provided with a patient support platform having a portion that is pivoted between a flat position and an inclined position by a motor powered by a battery during emergency usage. The emergency CPR switch includes: a first relay disposed between the battery and the motor; a controller configured to provide a motor control signal to control the motor; and a switch electrically connected to the first relay. When the switch is operated the first relay is activated to drive the motor with the battery in a direction placing the pivotable portion in the flat position and control of the motor by the motor control signal is disabled or overridden.

13 Claims, 5 Drawing Sheets

Related U.S. Application Data continuation-in-part of application No. PCT/US2013/067295, filed on Oct. 29, 2013.

(60) Provisional application No. 61/719,796, filed on Oct. 29, 2012.

(51) Int. Cl.

| | |
|---|---|
| ***A61G 13/08*** | (2006.01) |
| ***A61H 31/00*** | (2006.01) |
| ***A61G 13/10*** | (2006.01) |
| ***A61G 7/05*** | (2006.01) |

(52) U.S. Cl.
CPC ..... *A61G 13/08* (2013.01); *A61G 13/10* (2013.01); *A61G 2203/10* (2013.01)

(58) Field of Classification Search
USPC ..... 5/616–618, 613, 610, 611
See application file for complete search history.

(56) References Cited

U.S. PATENT DOCUMENTS

| | | | | |
|---|---|---|---|---|
| 4,953,243 | A | 9/1990 | Birkmann | |
| 6,566,833 | B2 | 5/2003 | Bartlett | |
| 6,611,979 | B2 | 9/2003 | Welling et al. | |
| 7,055,195 | B2 | 6/2006 | Roussy | |
| 7,296,312 | B2 | 11/2007 | Menkedick et al. | |
| 7,610,637 | B2 | 11/2009 | Menkedick et al. | |
| 9,009,893 | B2 | 4/2015 | Kramer et al. | |
| 2001/0032362 | A1 | 10/2001 | Welling et al. | |
| 2002/0138905 | A1 | 10/2002 | Bartlett et al. | |
| 2005/0172405 | A1 | 8/2005 | Menkedick et al. | |
| 2005/0283914 | A1 | 12/2005 | Roussy | |
| 2008/0289108 | A1 | 11/2008 | Menkedick et al. | |
| 2010/0064441 | A1 | 3/2010 | Barthelt | |
| 2012/0174319 | A1 | 7/2012 | Menkedick et al. | |
| 2015/0257972 | A1 | 9/2015 | Barta et al. | |
| 2018/0296434 | A1 * | 10/2018 | Barta | A61G 7/015 |

FOREIGN PATENT DOCUMENTS

| | | | | |
|---|---|---|---|---|
| EP | 2911638 | B1 * | 8/2018 | A61G 7/015 |
| JP | 2010521201 | A | 6/2010 | |
| WO | 2008113476 | A1 | 9/2008 | |

* cited by examiner

APPARATUS AND METHOD FOR PROVIDING EMERGENCY CPR FUNCTIONALITY ON A PATIENT SUPPORT SURFACE

CROSS-REFERENCE TO RELATED APPLICATIONS

This is a continuation application of U.S. patent application Ser. No. 14/698,143 filed on Apr. 28, 2015, which is a continuation-in-part application in the United States of International Patent Application No. PCT/US2013/067295, filed Oct. 29, 2013, pursuant to 35 USC § 365(c), which in turn claims benefit of priority to U.S. provisional application No. 61/719,796, filed on Oct. 29, 2012, the entire disclosures of which are expressly incorporated by reference herein.

FIELD OF THE DISCLOSURE

The present disclosure relates generally to patient support surfaces and more particularly to methods and apparatus for providing emergency cardiopulmonary resuscitation (CPR) functions on a patient support surface.

DESCRIPTION OF RELATED ART

Various apparatuses are known in the art for supporting patients. For example, some hospital and other beds include a mattress with a frame that is configured to raise and lower. Some such support apparatuses have a frame that can articulate and includes a back section, a seat section, and a leg section, each of which may be pivotable relative to one or more of the other sections. Often, the hospital beds employ linear actuators, which include motors, to lift and articulate the bed frame to various positions.

When the beds are connected to alternative current (AC) power and are functioning properly, software is used to control the position of the motors and thus the position of the bed. In an event where the clinician needs to initiate CPR or another emergency procedure on a patient in the bed, they will typically press a CPR button or pull a CPR lever and the bed software responds by controlling the motors to a position where the bed is flat and level. In cases where CPR is required but power to the bed is not available or there is an electrical problem with the bed, many beds have a provision for an emergency feature which mechanically lowers the head of the bed. Most often, this is accomplished by pulling a cable which releases a clutch on the linear actuator, causing the head motor to fall under gravity until the head of the bed is in a flat position. The limitation to this approach is that the head section is allowed to free fall onto the frame causing a potential for injury to the caregiver pulling the release handle and the patient in the bed due to the pinch points under the head section of the frame. Common feedback from nurses is that they are scared to pull the handle because the head section of the bed comes crashing down so loudly and abruptly.

In addition to increasing the risk of patient and caregiver injury, this back-up CPR method is more costly and requires more space to implement than the same actuator without the release clutch. A linear actuator equipped with a release clutch is approximately 40% more expensive than the same actuator without a release clutch. Additionally, routing the release cable and making room for the physically larger footprint of the actuator with the release clutch poses problems for low bed designs where space for additional components is very limited.

Some designs have attempted to solve the problem of having the head section fall rapidly by adding a gas spring in parallel with the head actuator. The limitations of this system are the additional cost of the gas spring and the space taken by the gas spring. Another limitation of the use of a gas spring is finding a constant that allows the head section to fall with very heavy and very light patients without heavy patients falling too quickly and light patient taking too long to descend to the flat position.

Accordingly, there is a need for improved apparatus and methods for providing CPR functionality on a hospital bed.

SUMMARY

This disclosure includes embodiments of patient support apparatuses, control units, and methods.

In accordance with an exemplary embodiment, a patient support surf ace is provided with an emergency CPR feature that does not require a mechanical clutch to lower the head section of the bed when there is a lack of AC power or an electrical problem with the bed.

By wiring the linear actuator that controls the head section of the bed directly to the battery, CPR can still be achieved when the bed is without AC power or there is an internal failure of the bed electronics or software. Setting a "false bottom" in the software to prevent the batteries from ever completely depleting will ensure that battery power is available in the emergency situations described above. Using the power from the batteries to drive the motor will ensure that the head section is always lowered in a controlled rate of descent and that the head section is not allowed to slam down when the emergency CPR feature is activated.

The term "coupled" is defined as connected, although not necessarily directly, and not necessarily mechanically; two items that are "coupled" may be integral with each other. The terms "a" and "an" are defined as one or more unless this disclosure explicitly requires otherwise. The terms "substantially," "approximately," and "about" are defined as largely but not necessarily wholly what is specified, as understood by a person of ordinary skill in the art.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method that "comprises," "has," "includes" or "contains" one or more steps possesses those one or more steps, but is not limited to possessing only those one or more steps.

Further, a device or structure that is configured in a certain way is configured in at least that way, but it can also be configured in other ways than those specifically described.

While exemplary embodiments of the present disclosure have been shown and described in detail below, it will be clear to the person skilled in the art that changes and modifications may be made without departing from the scope of the disclosure. As such, that which is set forth in the following description and accompanying drawings is offered by way of illustration only and not as a limitation. The actual scope of the invention is intended to be defined by the following claims, along with the full range of equivalents to which such claims are entitled.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

FIGS. 4*a* and 4*b* illustrate an exemplary schematic for implementing an emergency CPR feature, wherein FIG. 4*a* illustrates one electrical relay circuit and FIG. 4*b* illustrates another electrical relay circuit.

DESCRIPTION OF ILLUSTRATIVE EMBODIMENTS

Figure 1:
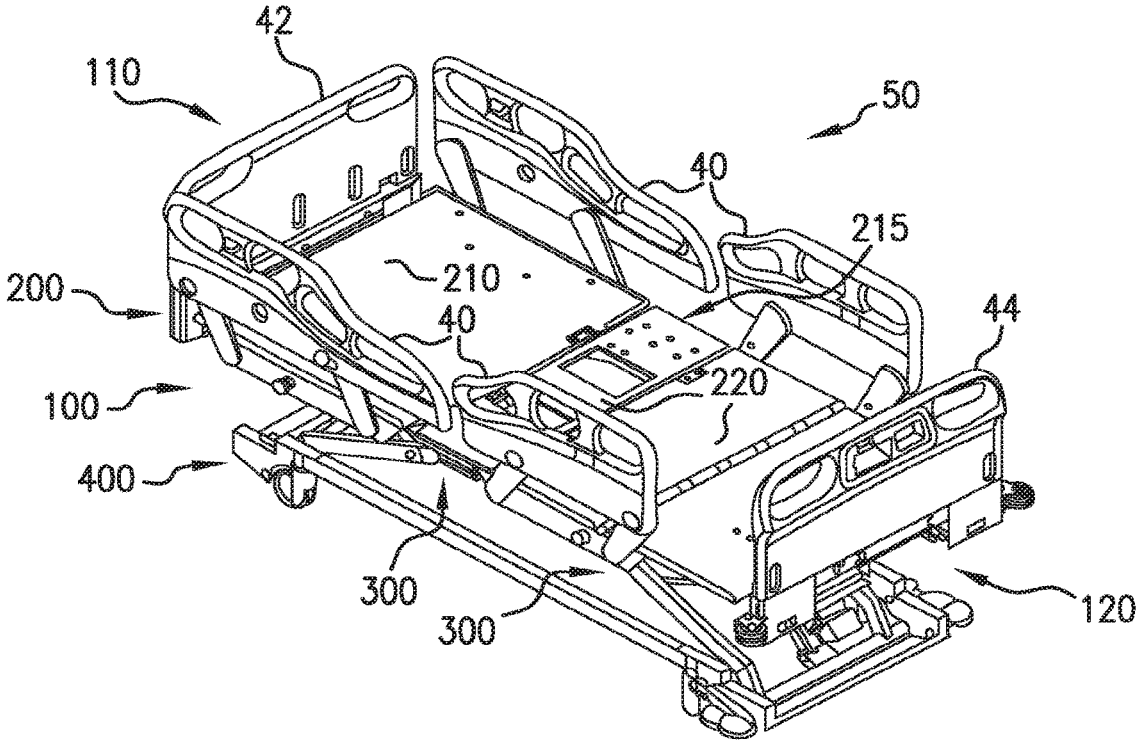
FIG. 1 depicts a perspective view of an example of a patient support bed comprising an exemplary embodiment of a patient support apparatus.
Figure 2:
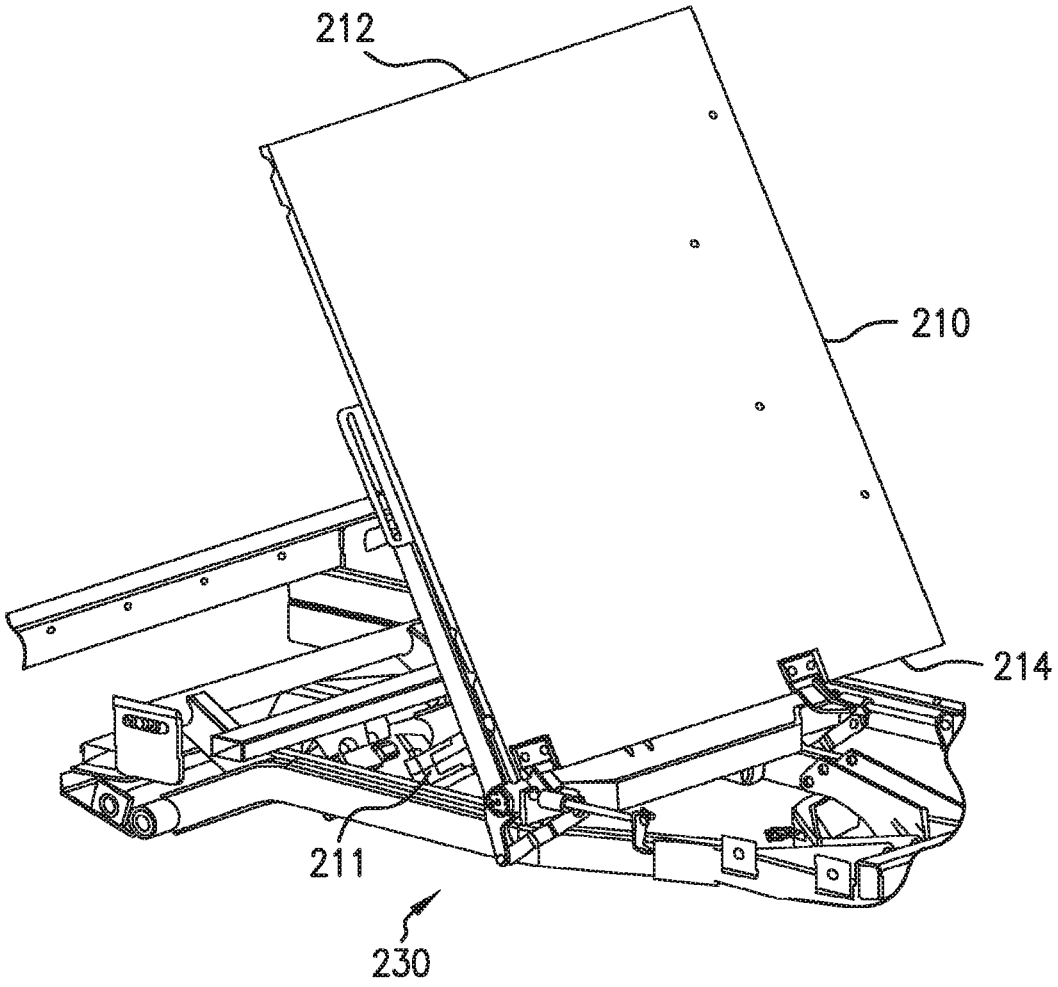
FIG. 2 depicts a perspective view of a pivoting mechanism of the patient support apparatus of FIG. 1 in a fully elevated position.

Referring now to the drawings, and more particularly to FIGS. 1 and 2, shown therein and designated by the reference numeral 50 is a patient support bed with which the present features may be implemented individually or in any suitable combination. In the embodiment shown, patient support bed 50 comprises a frame or support apparatus 100 having a head end 110 and a foot end 120. Apparatus 100 further comprises an upper frame 200 and a base frame 400, as well as a lifting assembly 300 configured to raise and lower upper frame 200 relative to base frame 400. Lifting assembly 300 comprises a plurality of pivoting members and actuators configured to raise and lower upper frame 200. In the embodiment shown in FIGS. 1-2, patient support bed 50 comprises a patient support platform 215 comprising a first portion 210 proximal to head end 110 and a second portion 220 proximal to foot end 120. The first portion 210 and the second portion 220 may be pivoted between a flat position (shown in FIG. 1) and an inclined position (shown in FIG. 2). Patient support bed 50 also comprises a plurality of side guards 40, a head end guard 42, and a foot end guard 44.

As shown in FIG. 2, the first portion 210 of the patient support platform 215 may be pivoted into an inclined position so that first end 212 is higher than second end 214. In the illustrated embodiment, the patient support platform 215 is pivoted using pivot mechanism 230. A linear actuator 211 exerts an upward force on the first portion 210 of the patient support platform to pivot the patient support platform into an inclined position. Further details regarding patient support bed 50 and pivot mechanism 230 are described in Provisional Patent Application No. 61/692,557 for a "Hospital Bed," filed on Aug. 30, 2012, which is hereby incorporated by reference in its entirety.

Figure 3:
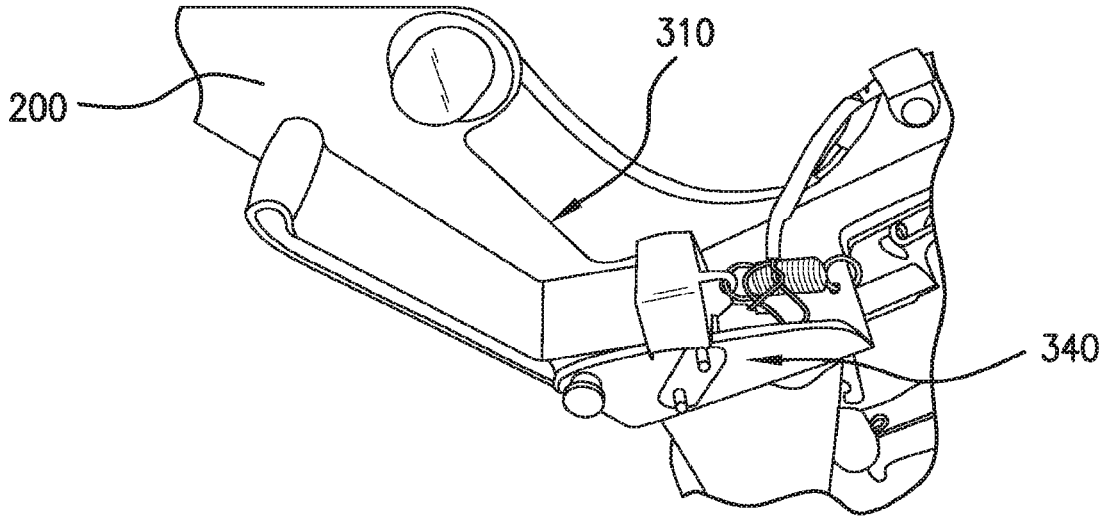
FIG. 3 illustrates an exemplary embodiment of an emergency CPR switch.

Referring to FIG. 3, a back-up CPR handle or lever 300 is located on at least one side of the bed frame 200. Alternatively, back-up CPR handles may be located on both sides of the bed frame or any other desirable locations. In the illustrated embodiment, the handle is mechanically coupled to an electro-mechanical limit switch 340, which changes state from normally open to closed when the CPR handle 300 is pulled. Thus, mechanical CPR activation, which is asserted when the CPR lever 300 is pulled, enables input into relay circuit 350 and into relay circuit 360. The normally opened mechanical CPR inputs go low when the lever 300 is pulled.

Figure 4A:
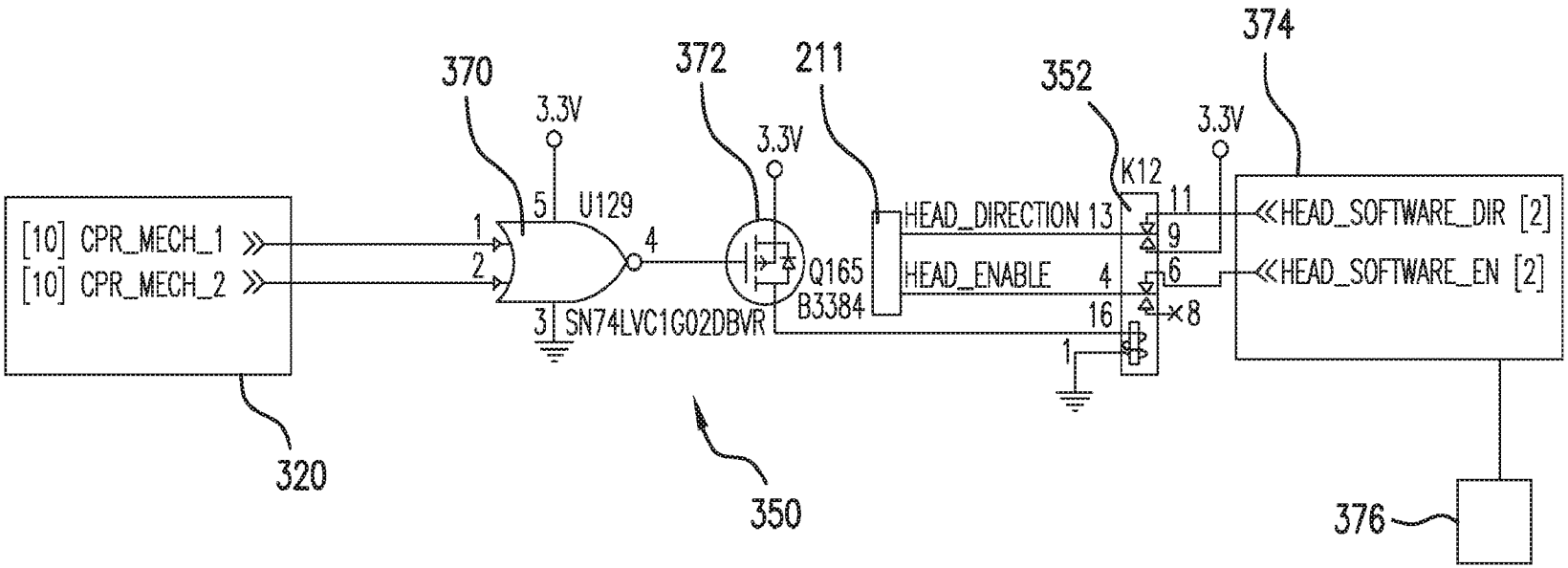
Figure 4B:
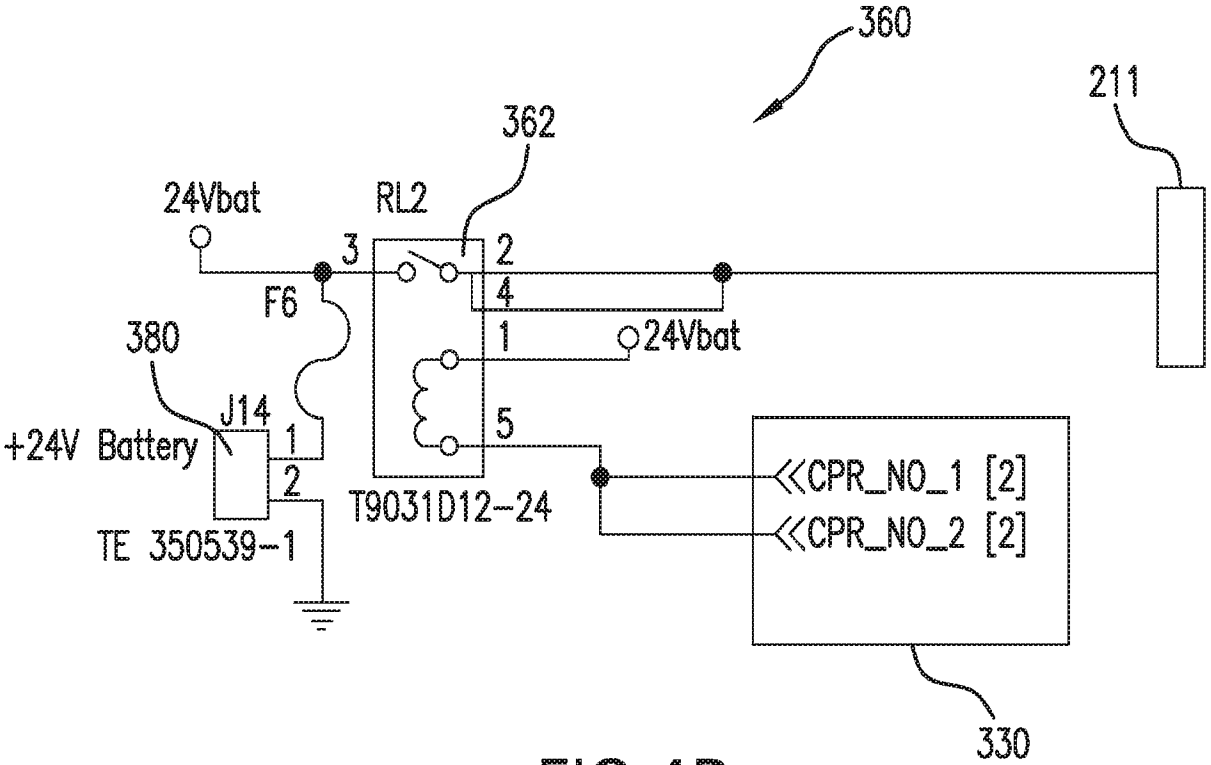

As seen in FIGS. 4*a* and 4*b*, the component limit switches 320, 330 are coupled to two electrical relays 352 and 362 of the relay circuits 350 and 360, respectively, which close when the limit switch 340 moves to its closed state. The closing of the relays 352, 362 connects battery power to the head motor (e.g., the linear actuator 211 for articulating the first portion 210 of the patient support bed) and disables or overrides the motor control signals from the main controller such that the head motor is forced to lower the first portion 210 into a flat position (i.e., a CPR position).

As shown in FIG. 4*a*, the relay circuit 350 includes a NOR gate 370 that receives input signals 1, 2 from component limit switch 320. Output 4 from the NOR gate 370 is input into a time delay circuit 372, which provides input 16 into the relay 352, which causes the relay to block the motor control output from terminals 13 and 4. Under normal circumstances before the CPR lever 300 is pulled, a microcontroller 374 provides head motor direction control signals and head motor enablement control signals to relay 352 via input terminals 11 and 6, respectively, in accordance with software of the microcontroller 374 controlling such inputs. The relay 352 then outputs head direction motor control signals from terminal 13 and head motor enablement control signals from terminal 4 to the head motor 211. However, when the CPR lever 300 is pulled, the result is an input signal to terminal 16 of the relay 352, which causes the relay to switch so that the software of the microcontroller 374 loses control of the head motor 211 with about a 2 millisecond time delay after the mechanical CPR lever 300 is pulled due to the time delay circuit 372 and the other component(s) of the relay circuit 350. Other terminals of the relay 352 include ground terminal 1, a reference 3.3 V voltage terminal 9 and an open terminal 8. The microcontroller 374 receives power from an AC power source 376.

As shown in FIG. 4*b*, relay circuit 360 includes a battery 380, such as a 24 V battery, that is connected to provide voltage input to terminal 3 of the relay 362. The component limit switch 330 is connected to provide signal input to terminal 5 of the relay 362 when the limit switch component 330 of the limit switch 340 is activated. Terminals 2 and 4 of the relay 362 are connected to provide power to one or more motors 211 when the mechanical CPR lever 300 causes the mechanical CPR normally-open inputs to go low, thereby forcing the battery relay open to provide power to motor 221. Terminal 1 of the relay 362 is connected to a 24 V reference voltage.

Combined, these two relay circuits 360 and 362 constitute two pieces of circuitry on a main controller board of the microcontroller 374 that operate together to disconnect the microcontroller 374 from the head motor(s) 211 while, at about the same time (subject to the approximately 2 ms delay of relay circuit 360), also ensuring that the motor(s) 211 get power. The result is, as long as the battery 380 is not damaged, the first portion 210 of the patient support platform 215 will lower, thereby lowering the head of the patient when the mechanical CPR lever 300 is pulled.

Because this system relies on one or more batteries 380 to drive down the head motor 211, it is important that the system always have a reserve of battery power to lower the head section 210 of the bed 50. In certain embodiments, reserve power is maintained by disconnecting battery power from the frame when the available power in the battery 380 drops below a set threshold. In this specific embodiment, reserve battery power is maintained by software action.

Controller hardware associated with the frame measures the battery voltage and provides this value to the software. When the voltage drops below a threshold value, the software opens a relay (i.e. a third relay) that disconnects the battery 380 from the rest of the circuit, thereby preventing further usage of the battery except for emergency CPR usage. In an exemplary embodiment, the threshold value is 50% battery capacity. In this way, the microcontroller 374 operates using power from an AC source 376, or using power from both the AC source 376 and the battery 380, unless the battery capacity falls below a threshold value in which case power cannot be drawn from the battery 380 for normal operation of the bed 50, but power may be drawn solely from the AC power source 376 for this purpose. On the other hand, the battery 380 is still available to power the motor 211 when the emergency CPR handle or lever 300 is activated.

A backup CPR system in accordance with the above described embodiments allows CPR to be initiated in the event of power loss or electrical failure without allowing the head section to rapidly descend placing the patient and caregiver at risk for injury or adding significant cost and components to the design. Furthermore, the disclosed embodiments of the backup CPR system reduce the number of components and the complexity of the design so that other features may be implemented or so that lower bed heights may be achieved, thereby benefiting caregivers and patients who use the product.

The various illustrative embodiments of the present devices, apparatus, and systems are not intended to be limited to the particular forms disclosed. Rather, they include all modifications and alternatives falling within the scope of the claims. For example, embodiments other than the one shown may include some or all of the features of the depicted embodiment.

The claims are not intended to include, and should not be interpreted to include, means-plus-or step-plus-function limitations, unless such a limitation is explicitly recited in a given claim using the phrase(s) "means for" or "step for," respectively.

It will be understood that the benefits and advantages described above may relate to one embodiment or may relate to several embodiments. It will further be understood that reference to 'an' item refers to one or more of those items, unless otherwise specified. The steps of the methods described herein may be carried out in any suitable order, or simultaneously where appropriate.

Where appropriate, aspects of any of the examples described above may be combined with aspects of any of the other examples described to form further examples having comparable or different properties and addressing the same or different problems. It will be understood that the above description of embodiments is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the scope of this invention.

The invention claimed is:

1. An emergency CPR switch attached to a hospital bed provided with a patient support platform having a portion that is pivoted between a flat position and an inclined position by a motor powered by a battery during emergency usage, comprising:

a first relay disposed between the battery and the motor;

a controller configured to provide a motor control signal to control the motor; and a switch electrically connected to the first relay, wherein when the switch is operated the first relay is activated to drive the motor with the battery in a direction placing the pivotable portion in the flat position and control of the motor by the motor control signal is disabled or overridden.

2. The emergency CPR switch of claim 1, further comprising:

a second relay between the controller and the motor, wherein when the switch is operated the second relay is switched to disconnect the controller from the motor.

3. The emergency CPR switch of claim 2, wherein the controller receives power from and provides the motor control signal to control the motor to be driven by at least one of an AC power source, the battery, or any combination thereof, when an available power in the battery satisfies a threshold level, and wherein the controller receives power from and provides the motor control signal to control the motor to be driven by only the AC power source when the available power in the battery fails to satisfy the threshold level.

4. A patient support apparatus, comprising:

a frame having a head end and a foot end;

a patient support platform disposed on the frame, comprising a first portion proximal to the head end and a second portion proximal to the foot end;

a linear actuator disposed to pivot the first portion between a flat position and an inclined position;

a battery disposed to provide power to the linear actuator;

a first relay disposed between the battery and the linear actuator; and an emergency switch electrically connected to the first relay, wherein when the emergency switch is operated the first relay is activated to drive the linear actuator, wherein the linear actuator articulates the first portion of the patient support platform toward a flat position under the drive of the linear actuator when the first relay is activated by operation of the emergency switch.

5. The patient support apparatus of claim 4, further comprising:

a second relay configured to be activated to drive the linear actuator to articulate the first portion of the patient support platform toward a flat position or an inclined position based on motor control signals from a microcontroller, wherein the second relay is configured to be deactivated by operation of the emergency switch.

6. The patient support apparatus of claim 5, wherein when a voltage of the battery satisfies a threshold value, the linear actuator is powered by either voltage from the battery, or by voltage from an AC power source, or by both voltage from the battery and voltage from the AC power source.

7. A method of providing an emergency CPR function in a patient support surface, comprising:

disabling or overriding, upon actuation of an emergency CPR switch, control of a powered drive by a drive control signal provided by a main controller; and supplying power to the powered drive to place the patient support surface in a CPR position upon actuation of the emergency CPR switch.

8. The method of claim 7, wherein supplying power to the powered drive upon actuation of the emergency CPR switch comprises activating a relay to connect the powered drive with a power source.

9. The method of claim 8, wherein the power source includes a battery.

10. The method of claim 9, further comprising:

monitoring the voltage of the battery;

supplying, based on the drive control signal, power from an AC source to the powered drive to place the patient support surface in the CPR position when a capacity of the battery violates a threshold voltage; and supplying, upon actuation of the emergency CPR switch, power to the powered drive from the battery to place the patient support surface in the CPR position when the voltage of the battery violates the threshold voltage.

11. The method of claim 10, wherein the threshold voltage corresponds to 50% of battery capacity.

12. The method of claim 7, further comprising disconnecting the main controller from the powered drive.

13. The method of claim 7, further comprising:

directly connecting the powered drive to a battery upon actuation of the emergency CPR switch.

* * * * *